United States Patent [19]

McNary

[11] Patent Number: 4,999,961

[45] Date of Patent: Mar. 19, 1991

[54] CORNER POST OPENING CLOSURE

[76] Inventor: Drew McNary, Sunset Dr., Brewster, N.Y. 10509

[21] Appl. No.: 415,620

[22] Filed: Oct. 2, 1989

[51] Int. Cl.[5] ..... E04H 12/00

[52] U.S. Cl. ..... 52/288; 52/301; 52/745

[58] Field of Search ..... 52/731, 105, 288, 301, 52/745; 312/11, 140; 256/21, DIG. 5

[56] References Cited

U.S. PATENT DOCUMENTS

| | | | |
|---|---|---|---|
| 787,613 | 4/1905 | D'Esposito | 52/731 |
| 2,034,709 | 3/1936 | Camp | 256/DIG. 5 |
| 2,731,116 | 1/1956 | Allison | 52/731 |
| 2,926,941 | 3/1960 | Thompson | 446/111 |
| 3,004,814 | 10/1961 | Schulze | 312/111 |
| 3,368,798 | 2/1968 | Kusel et al. | 256/21 |
| 4,480,419 | 11/1984 | Crites | 52/126.4 |
| 4,731,973 | 3/1988 | Stenemann | 312/140 |

*Primary Examiner*—James L. Ridgill, Jr.
*Attorney, Agent, or Firm*—Joseph B. Taphorn

[57] ABSTRACT

The upper and lower ends of a hollow plastic corner post for a corner structure are each closed off with a device molded of a cuttable plastic whether or not the corner structure continues past the end of the post. The device includes a base having along the sides of one corner risers adapted to be received within the hollow plastic corner post. The other corner is marked with lines indicating distances from the edge near the ridge parallel to the lines. The distances from the outer edges of the corner post to interfering corner structure are measured, and material beyond the lines indicating these distances are cut from the base to form an indented corner. The trimmed device is then seated on the end of the corner post and fastened in position. The device for an end terminating flush with the surface of the structure may need no trimming.

7 Claims, 3 Drawing Sheets

CORNER POST OPENING CLOSURE

BACKGROUND OF THE INVENTION

1. Field of the Invention

This invention relates to a plastic molded device and method of using it, and more particularly to a plastic molded device and method of using it for easily closing off variously sized and situated opening on the ends of hollow plastic corner posts used in the construction of homes and other buildings.

2. Description of the Prior Art.

Plastics such as vinyl are increasingly being used as building external coverings. Such coverings frequently embody extruded hollow plastic corner posts. The corner posts are formed with two sides interconnected along their inner edges and which will be spaced from the walls of corner structures to which they are to be attached by siding receiving notches formed between the outer edges of the sides and flanges for attaching the post of the corner structure sides. Thus the hollow corner post is open at its top and bottom ends and exposes the building to the entry of insects, rats, squirrels and other vermin, and moisture.

To close off these corner post openings, the construction industry today fashions on the job an end cap insert from sheet metal or scrap pieces. Not only is such fashioning time consuming and hence expensive, but it may also be ineffective due to the difficulty of precisely sizing the insert. Thus not only may moisture and vermin slip by the open edges of the insert, but also the insert itself may fall out of the opening to expose the hollow corner post to the entrance of larger vermin. An earlier cap consisting of a flat piece with upturned out edges, was a failure.

SUMMARY OF THE INVENTION

Accordingly, it is an object of the invention to provide a hollow-corner-post closure device or cap that is highly effective and permanent in keeping out moisture and vermin, that can be used at both the upper and lower ends of a corner post, and that can be readily trimmed to meet construction situations.

Another object of the invention is to provide a hollow corner post closure device that is inexpensive of construction and easy of installation.

These and other objects are obtained through the design of a moldable piece of cuttable plastic. The piece is formed of a generally rectangular base having two risers at one corner of its inside surface; the risers are intended to be received within the corner post and engage the sides of its interior corner remote from the home. The opposite corner of the base may have markings on its inside (or outside) surface for facilitating trimming the base to precisely fit an interfering construction corner continuing past the end of the corner post. Preferably, the markings are lines set off at regular intervals and parallel to the respective sides of the corner; the lines from one side may interconnect with corresponding ones from the other.

The risers may be spaced from the outer edges of the base to define a lip on the base for engaging the edges on the top or bottom of the sides of a hollow corner post. The risers may also be interconnected with a diagonal riser to form a strong construction.

A substantial advantage of the invention is the tight fit the device may be made to have not only with the top and bottom of the hollow corner post but also with the corner structure. Thus, in the case of a cap abutting (not overlying) a structure, the inner surface of the base may overlap the edges of the hollow corner post sides while the trimmed edges of the base precisely engage the corner structure because the base is formed of a cuttable plastic.

As noted above, the inner surface of the base is marked to facilitate its trimming. Thus lines are inscribed on the surface about the corner opposite that having the risers and labeled to indicate the distance from the corresponding outer edge of the base. (Corresponding distance lines may interconnect). A measurement taken from the corresponding side of the corner post to the home structure indicates the distance and hence the line at which the cuttable plastic base should be trimmed. Of course, this must be done for both sides of the corner.

The above design enables a novel installation method. The installer measures the distances from the corner structure to the outside sides of the corner post, cuts from a corner of the rectangular base opposite the corner having risers material leaving the base with material equal to the measured distances, and inserts the risers into the corner post to close off its corner post opening and precisely fit the home structure.

BRIEF DESCRIPTION OF THE DRAWINGS

The above and other objects, features and advantages of the invention will become apparent from a consideration of the following description of an illustrative embodiment thereof, when taken together with the accompanying drawings wherein.

DETAILED DESCRIPTION OF THE PREFERRED EMBODIMENT

Figure 2:
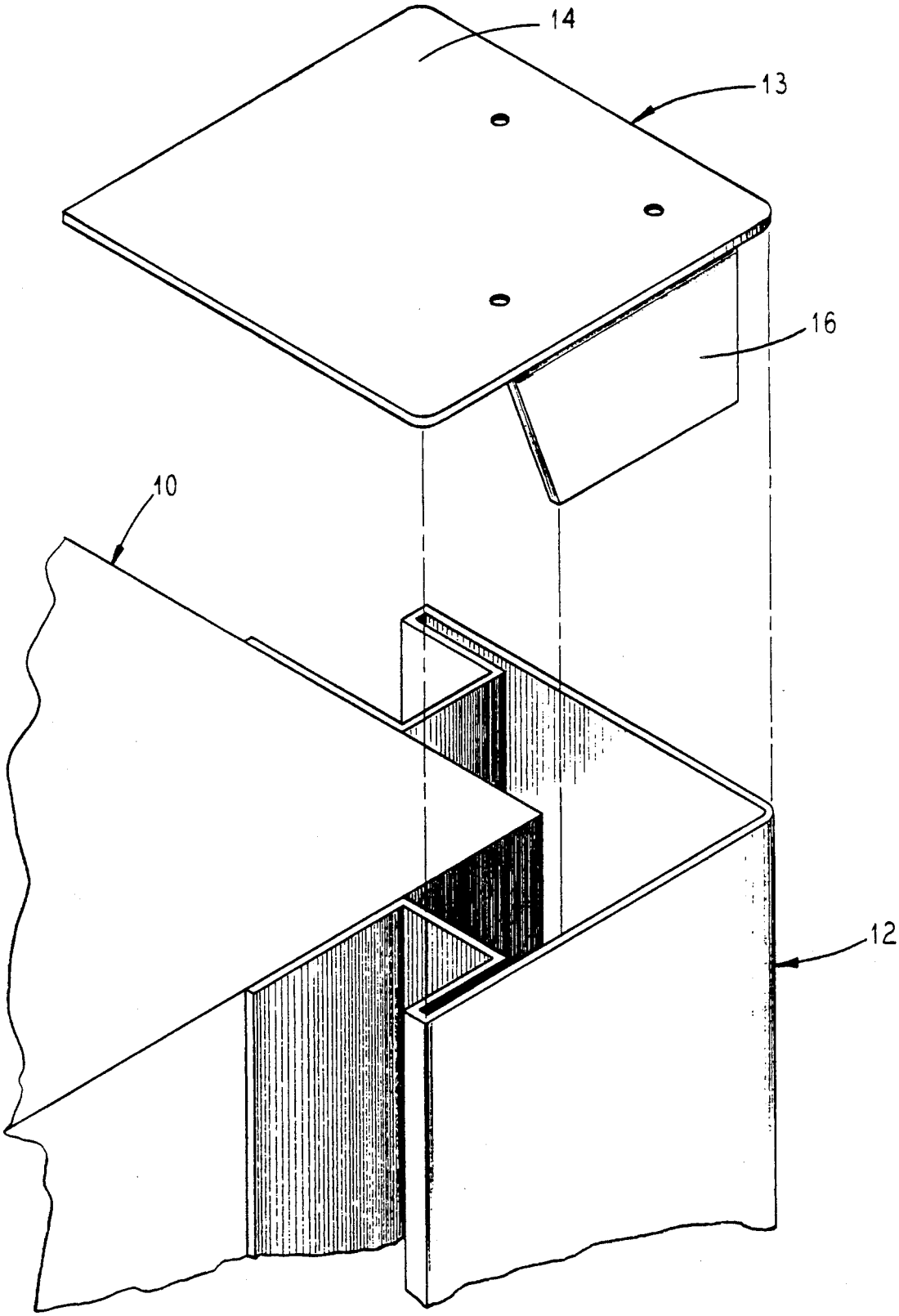
FIG. 2 is an oblique, exploded view of a hollow-corner post installation wherein the upper edges of the post are flush with the upper surface of the home structure, with the full cap separated.

Referring now to the drawings, there is shown in FIG. 2, a portion of a building having a corner structure 10 and a hollow plastic corner post 12 secured to the corner structure and with the upper edges of the corner post terminating flush with the upper surface of the corner structure 10. Thus, the hollow corner post 12 presents an opening at its upper end, and may also do so at its lower end. These openings are closed off by molded plastic closure device or cap 13 having a base 14.

Figure 1:
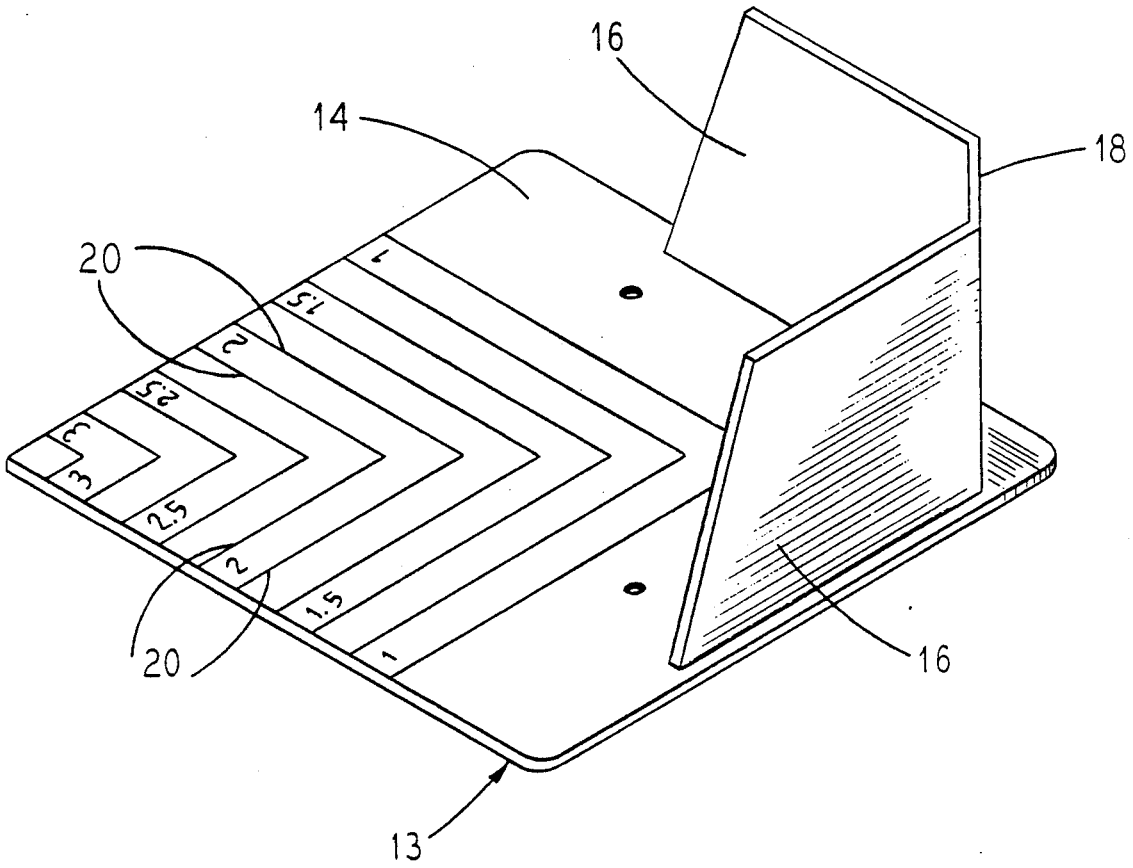
FIG. 1 is an isometric view of a hollow-corner post closure device or cap in inverted position with its inner surface showing.

As best seen in FIG. 1 the cap base 14 is generally rectangular and of a thickness sufficient to provide the necessary strength and rigidity. It is of a size sufficient to cover the end of the corner post. At one corner of the base 14, the sides of the corner are molded with risers 16 intended to be received within the hollow corner post so as to engage the sides of the interior corner of the post 12 remote from the corner structure for fastening as by screws or rivets. The risers 16 may be interconnected by a diagonal riser 18 to form a stronger construction. The risers are set in from the edges of the base 14 to define a lip for seating the closure device on the corner post 12.

The inside surface of the base 14 is marked with lines 20. The lines 20 are labeled with numerals indicating their distances from the base edge juxtaposed to the riser 16 parallel to the lines.

Breathing or weep holes 21 formed in the base 14 interior of the risers 16 allow moisture to escape and thus prevent condensation impacting the corner structure 10.

In installing the closure device or cap 13 on a hollow corner post whose edges are flush with the upper surface of the corner structure 10 (FIG. 2), the base 14 need not be trimmed as it may overlie the upper surface of the corner structure 10. The risers 16 are received within the hollow corner post, and may be secured to the respective sides of the corner post as by screws or rivets passing through aligned aperatues therein. With the base 14 overlying all of the end of the hollow corner post, the upper end of the corner post is secured against entry of insects, rats, squirrels, and other vermin, and moisture.

Figure 3:
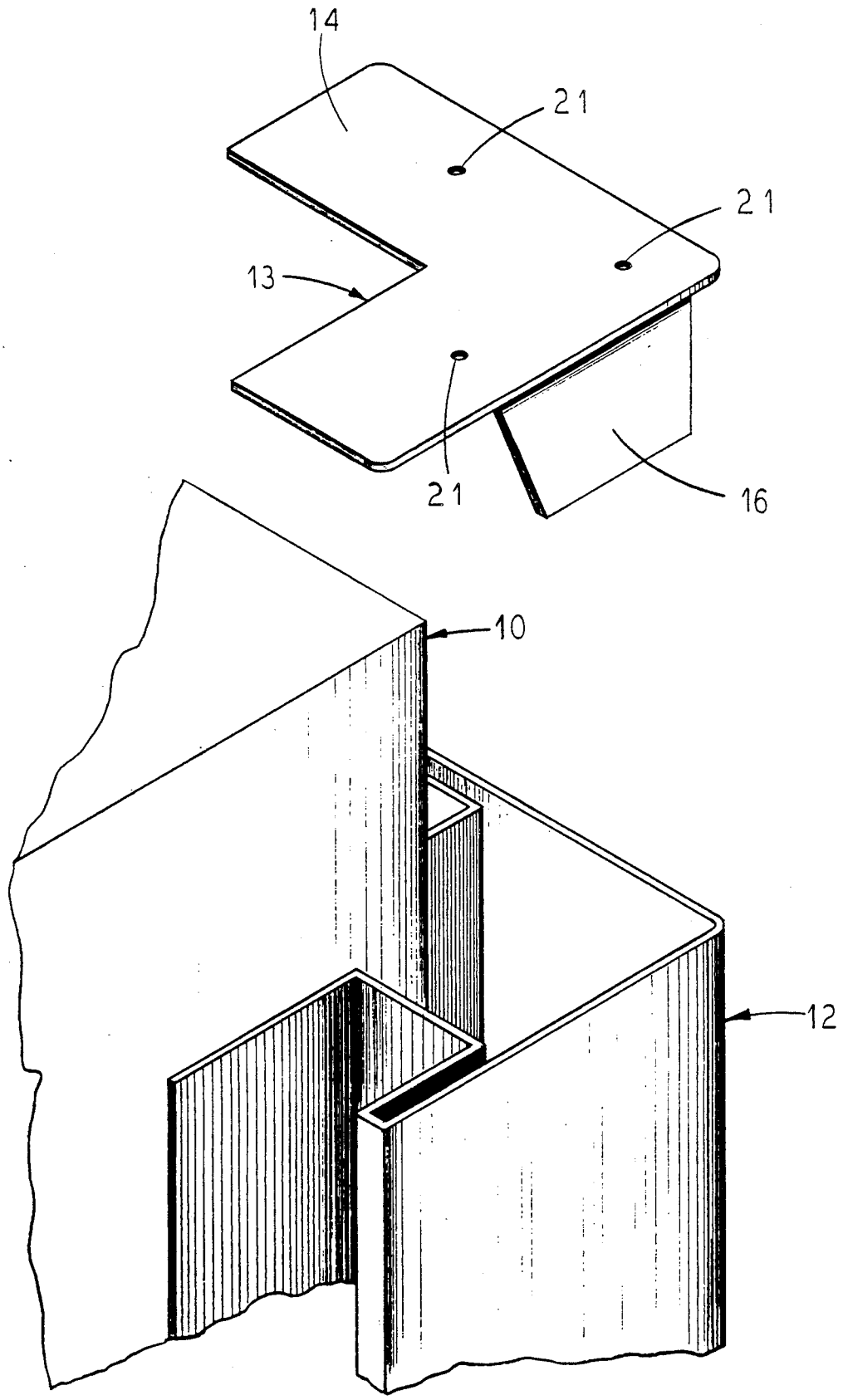
FIG. 3 is an oblique, exploded view of a hollow-corner-post installation wherein the upper edges of the post are below the upper surface of the corner structure (corner structure continues past end of corner post), with the trimmed cap separated.

In installing the closure device or cap 13 on a hollow corner post whose edges are below the upper surface of the corner structure (FIG. 3) (structure not terminating with post), the installer first measures the distances from the outer edges of the corner post 12 to the corresponding sides of top corner structure 10. He then cuts the base 14 to remove the material beyond the lines labeled for those distances to form an indented corner. He then inserts the risers 16 into the lower end of the corner post and so that they engage the sides of the interior corner remote from the corner structure 10. The sides of the indented corner of the base 14 will be in snug engagement with the corresponding sides of the corner structure 10. The closure device can be secured in place as by screws or rivets.

It will be appreciated that while the caps 13 have been shown as closing off the upper ends of hollow corner posts, exactly the same means and techniques can be used to close off their lower edges. The only difference is that the risers are inserted upwards into the posts.

It will be also appreciated that while the invention has been described with reference to a particular embodiment, that the description is illustrative only, that the invention can be incorporated in many other embodiments, that various modifications can be made without departing from the spirit of the invention, and that it is intended that the scope of the invention be limited only by the following claims.

What is claimed is:

1. A generally-square plastic device for closing off the end of a corner structure hollow plastic corner post partially embracing the corner structure, including a base and risers from only one corner of the base for engaging the sides of the interior of the corner post remote from the structure, and the base is formed of a readily cuttable plastic to facilitate trimming the base to precisely fit the corner structure and close off completely the corner post opening, and the risers are situated on the sides away from those where trimming will take place.

2. A plastic device according to claim 1, wherein the risers are spaced from the outer edges of the base to define a lip on the base for engaging the edges of the sides of the hollow corner post.

3. A plastic device according to claim 1, wherein the risers are interconnected with a diagonal riser to form a strong construction.

4. A plastic device according to claim 1, having markings on the base about its corner opposite that having the risers for facilitating trimming the base to precisely fit the corner structure.

5. A plastic device according to claim 4, wherein the markings on the base about its corner opposite that having the risers are lines set off at regular intervals and perpendicular to the sides of the corner.

6. A plastic device according to claim 5, wherein the lines from one side interconnect with corresponding ones from the other side.

7. A method of closing off an end opening of a hollow plastic corner post where the corner structure continues past the end of the corner post including measuring the distances from the corner structure to the outside sides of the corner post, cutting away a base having risers on one corner to engage the sides of the interior corner of the corner post remote from the corner structure on its opposite corner to distances proportional to the measurements, and inserting the risers in the corner post to close off the opening and precisely fit the corner structure.

* * * * *